US008400475B2

(12) United States Patent
Park et al.

(10) Patent No.: US 8,400,475 B2
(45) Date of Patent: Mar. 19, 2013

(54) METHOD FOR PROCESSING DATA, DRIVING APPARATUS FOR PERFORMING THE METHOD AND DISPLAY APPARATUS HAVING THE DRIVING APPARATUS

(75) Inventors: Po-Yun Park, Asan-si (KR); Dong-Won Park, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 859 days.

(21) Appl. No.: 12/543,734

(22) Filed: Aug. 19, 2009

(65) Prior Publication Data

US 2010/0177107 A1 Jul. 15, 2010

(30) Foreign Application Priority Data

Jan. 15, 2009 (KR) ..... 10-2009-0003174

(51) Int. Cl.
*G09G 5/38* (2006.01)

(52) U.S. Cl. ..... 345/658

(58) Field of Classification Search ..... 345/649, 345/656, 658, 659, 699
See application file for complete search history.

(56) References Cited

U.S. PATENT DOCUMENTS

| | | | | |
|---|---|---|---|---|
| 6,628,254 | B1 | 9/2003 | Matsumura | |
| 6,836,268 | B1 | 12/2004 | Song | |
| 7,050,071 | B2 * | 5/2006 | Wyatt et al. | 345/649 |
| 2003/0231154 | A1 * | 12/2003 | Yeo et al. | 345/89 |
| 2005/0275665 | A1 | 12/2005 | Kejser | |
| 2006/0132479 | A1 * | 6/2006 | Hong | 345/213 |
| 2007/0103631 | A1 | 5/2007 | Moon et al. | |
| 2007/0146479 | A1 | 6/2007 | Huang et al. | |
| 2008/0297511 | A1 * | 12/2008 | Chou et al. | 345/699 |

FOREIGN PATENT DOCUMENTS

| | | | |
|---|---|---|---|
| JP | 3852773 | B2 | 9/2006 |
| KR | 1020050020229 | A | 3/2005 |
| KR | 1020070070748 | A | 7/2007 |
| WO | 2005059882 | A1 | 6/2005 |

OTHER PUBLICATIONS

European Search Report; Aug. 2, 2010; Application No./Patent No. 09011360.6-1228 / 2209108; Reference p. 18519EP.

"VESA Display Information Extension Block Standard", VESA Display Information Extension Standard, Aug. 21, 2001, pp. 1-62, XP002428073.

"VESA "Plug & Play" (PnP) Standard for the Display/Graphics Subsystem"; VESA "Plug & Play" (PNP) Standard for the Display/Graphics Subsystem, Jul. 7, 2004; pp. 1-38, XP002591747.

"Active Matrix Liquid Crystal Displays: Fundamentals and Applications"; Willem Den Boer; 2005, Elsevier, UK, ISBN: 0750678135, pp. 1-77.

European Office Action for Application No. 09 011 360.6-1228 dated Oct. 28, 2011.

* cited by examiner

*Primary Examiner* — Jeffery A Brier
(74) *Attorney, Agent, or Firm* — Cantor Colburn LLP

(57) ABSTRACT

A method for processing data includes; storing image data of a p-th frame, wherein p is a natural number, determining a display mode of the image data of the p-th frame based on the number of pulses of a data enable signal corresponding to the image data of the p-th frame, and processing the image data of the p-th frame according to the determined display mode.

19 Claims, 7 Drawing Sheets

METHOD FOR PROCESSING DATA, DRIVING APPARATUS FOR PERFORMING THE METHOD AND DISPLAY APPARATUS HAVING THE DRIVING APPARATUS

This application claims priority to Korean Patent Application No. 2009-3174, filed on Jan. 15, 2009, and all the benefits accruing therefrom under 35 U.S.C. §119, the contents of which in its entirety are herein incorporated by reference.

BACKGROUND OF THE INVENTION

1. Field of the Invention

The present invention relates to a method for processing data, a driving apparatus for performing the method and a display apparatus having the apparatus. More particularly, the present invention relate to a method for processing data for improving display quality, a driving apparatus for performing the method and a display apparatus having the driving apparatus.

2. Description of the Related Art

Conventionally, a liquid crystal display ("LCD") apparatus includes an LCD panel, a printed circuit board ("PCB") on which a driving chip is mounted to drive the LCD panel, source tape carrier packages ("TCPs") on which source driving chips are mounted to electrically connect the PCB to the LCD panel, and gate TCPs on which gate driving chips are mounted. The conventional LCD panel includes a plurality of unit pixels arranged in a matrix form, vertically extended data lines for providing the unit pixels with data signals, and horizontally extended gate lines for scanning the unit pixels.

A gate-IC-less ("GIL") structure in which the gate TCPs have been removed and a gate driving circuit formed directly on the LCD panel have been developed and applied in order to decrease the size of the LCD apparatus and reduce manufacturing costs.

In addition, a horizontal pixel structure in which a longer side of sub-pixels which represents a single color and included in the unit pixels is aligned with a top side of the display panel is used to decrease the number of a source driving chip. In this typical horizontal pixel structure, relatively longer sides of red, green and blue color pixels are aligned along the horizontally extended gate lines, and relatively shorter sides of the red, green and blue color pixels are aligned along the vertically extended data lines. By using both of the GIL structure and the typical horizontal pixel structure, the number of components of the LCD apparatus and manufacturing costs are remarkably decreased.

However, an output image of the LCD apparatus having the typical horizontal pixel structure may be distorted because dimensions of a length and a breadth of each color pixel are reversed in comparison with an normal output image of the conventional LCD which does not have the typical horizontal pixel-arrange structure.

BRIEF SUMMARY OF THE INVENTION

Exemplary embodiments of the present invention provide a method for processing data capable of increasing display quality by displaying an output image in a normal direction with respect to a user view.

Exemplary embodiments of the present invention also provide a data processing apparatus for performing the above-mentioned method.

Exemplary embodiments of the present invention further also provide a display apparatus having the above-mentioned data processing apparatus.

According to one exemplary embodiment of the present invention, a method for processing image data includes storing image data of a p-th frame, wherein p is a natural number, determining a display mode of the image data of the p-th frame based on a number of pulses of a data enable signal corresponding to the image data of the p-th frame, and processing the image data of the p-th frame in accordance with the determined display mode.

In an exemplary embodiment of the present invention, the processing the image data of the p-th frame may include rotating the stored image data of the p-th frame when the determined display mode of the image data is a non-self-pivotable display mode in which a width of an image data is longer than a length of an image data.

In an exemplary embodiment of the present invention, the processing the image data of the p-th frame may further include compensating image data of a (p+1)-th frame using the stored image data of the p-th frame, when the determined display mode of the image data is a self-pivotable display mode.

In an exemplary embodiment of the present invention, the compensating the image data of the (p+1)-th frame may be performed without rotating the stored image data.

In an exemplary embodiment of the present invention, a width of the image data of a p-th frame of the non-self-pivotable display mode may be longer than a length of the image data of the p-th frame of the non-self-pivotable display mode and the length of the image data of the p-th frame of the self-pivotable display mode may be longer than the width of the image data of the p-th frame of the self-pivotable display mode.

In an exemplary embodiment of the present invention, the non-self-pivotable display mode may be a basic input/output system mode, and the self-pivotable display mode may be a window mode.

In an exemplary embodiment of the present invention, the image data of the p-th frame may be further compressively encoded before storing the image data of a p-th frame, and the encoded image data of a p-th frame may be further decoded before processing the image data of a p-th frame.

According to another exemplary embodiment of the present invention, a data processing apparatus includes; a storage part which stores image data of a p-th frame, wherein p is a natural number, a mode determining part which determines a display mode of the image data of the p-th frame based on the number of pulses of a data enable signal corresponding to the image data of the p-th frame, and a data processing part which processes the image data of the p-th frame to correspond to a display panel in accordance with the determined display mode.

In an exemplary embodiment of the present invention, the data processing apparatus may further include an encoder which compressively encodes the image data of the p-th frame to provide the storage part with an encoded p-th frame image data and a decoder which decodes the encoded p-th frame image data to provide the data processing part with a decoded p-th frame image data.

In an exemplary embodiment of the present invention, the data processing part may include a rotating part which rotates the image data of a p-th frame when the display mode is a non-self-pivotable display mode, and a compensating part which compensates image data of a (p+1)-th frame based on the image data of the p-th frame when the display mode is a self-pivotable display mode.

In an exemplary embodiment of the present invention, the compensating part may include a lookup table which stores compensation data that is compensated image data of the image data of the (p+1)-th frame in correspondence with the image data of the p-th frame and the image data of the (p+1)-th frame.

In an exemplary embodiment of the present invention, a width of the image data of the p-th frame of the non-self-pivotable display mode may be longer than a length of the image data of the p-th frame of the non-self-pivotable display mode and the length of the image data of the p-th frame of the self-pivotable display mode may be longer than the width of the image data of the p-th frame of the self-pivotable display mode.

In an exemplary embodiment of the present invention, the non-self-pivotable display mode may be a basic input/output system mode, and the self-pivotable display mode may be a window mode.

In an exemplary embodiment of the present invention, the data processing apparatus may further include a multiplexer which selectively outputs one of an output signal from the compensating part and an output signal from the rotating part.

According to still another exemplary embodiment of the present invention, a display apparatus includes a display panel including a data line extended in a horizontal direction and a gate line extended in a vertical direction substantially perpendicular to the horizontal direction, the gate line being shorter in length than the data line, and a data processing apparatus which processes image data of a p-th frame, wherein p is a natural number, according to a display mode of the image data of the p-th frame determined based on the number of pulses of a data enable signal corresponding to the image data of a p-th frame.

In an exemplary embodiment of the present invention, the data processing apparatus may include; a storage part which stores the image data of a p-th frame, a mode determining part which determines the display mode based on the number of pulses of the data enable signal, a rotating part which rotates the image data of a p-th frame data when the display mode is a non-self-pivotable display mode, a compensating part which compensates image data of a (p+1)-th frame based on the image data of the p-th frame when the display mode is a self-pivotable display mode.

In an exemplary embodiment of the present invention, the display panel may include a plurality of first pixel rows each having a plurality of first pixels arranged along the horizontal direction and a plurality of second pixel rows each having a plurality of second pixels arranged along the vertical direction, and a pair of data lines is electrically connected to one of the plurality of first pixel rows, and a gate line is electrically connected to a pair of second pixel rows of the plurality of second pixel rows.

In an exemplary embodiment of the present invention, the mode determining part may determine the display mode as the self-pivotable display mode when the number of pulses corresponding to the image data of the p-th frame is substantially equal to the number of the second pixels.

In an exemplary embodiment of the present invention, the mode determining part may determine the display mode as the non-self-pivotable display mode, when the number of the pulses corresponding to the image data of the p-th frame is substantially different from the number of the second pixels, e.g., the number of the pulses is greater and/or less than the number of the second pixels.

In an exemplary embodiment of the present invention, two of the first pixels may be connected to a single data line of the pair of data lines, and two subsequent first pixels along the vertical direction may be connected to another single data line of the pair of data lines. Alternative exemplary embodiments include configurations wherein one of the first pixels may be connected to a single data line of the pair of data lines, and an adjacent first pixel along the vertical direction may be connected to the other data line of the pair of data lines.

In an exemplary embodiment of the present invention, the data processing apparatus may include a multiplexer which selectively outputs one of an output signal of the compensating part and an output signal of the rotating part in response to the display mode.

According to the present invention, an output image displayed on the display panel in correspondence with a non-self-pivotable display mode and an output image displayed on the display panel in correspondence with a self-pivotable display mode are displayed on the display panel in normal positions, so that the display quality of the display panel may be enhanced.

BRIEF DESCRIPTION OF THE DRAWINGS

The above and other aspects, features and advantages of the present invention will become more apparent by describing in detail exemplary embodiments thereof with reference to the accompanying drawings, in which.

DETAILED DESCRIPTION OF THE INVENTION

Figure 1:
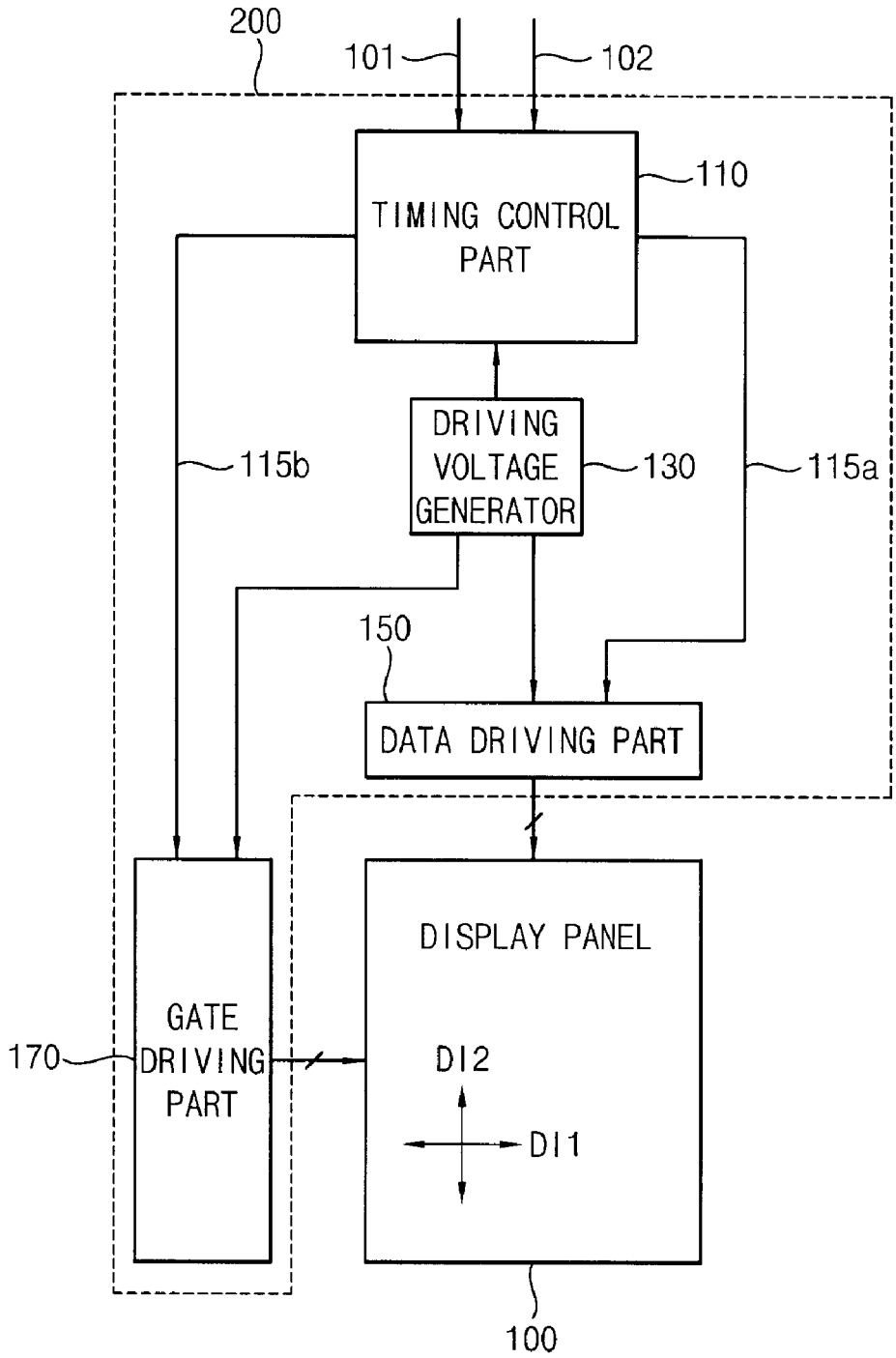
FIG. 1 is a block diagram illustrating a first exemplary embodiment of a display apparatus according to the present invention.

This invention now will be described more fully hereinafter with reference to the accompanying drawings, in which exemplary embodiments of the invention are shown. This invention may, however, be embodied in many different forms and should not be construed as limited to the exemplary embodiments set fourth herein. Rather, these exemplary embodiments are provided so that this disclosure will be through and complete, and will fully convey the scope of the invention to those skilled in the art. Like reference numerals refer to like elements throughout.

It will be understood that when an element or layer is referred to as being "on" another element, it can be directly on the other element or intervening elements may be present. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the invention are described herein with reference to cross-sectional illustrations that are schematic illustrations of idealized example embodiments (and intermediate structures) of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

Exemplary Embodiment 1

Figure 2:
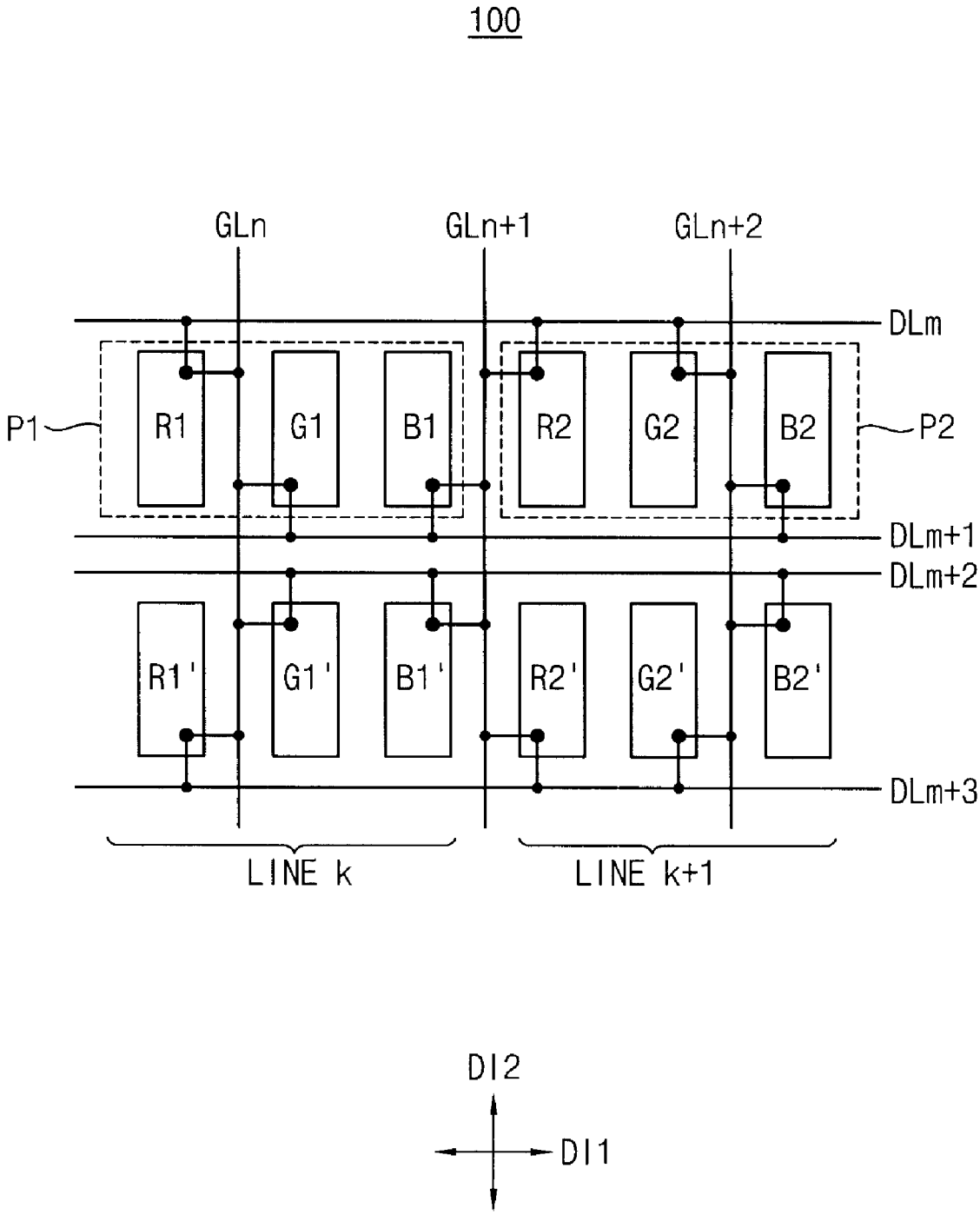
FIG. 2 is a schematic diagram illustrating an exemplary embodiment of a pixel structure of an exemplary embodiment of a display panel of FIG. 1.

FIG. 1 is a block diagram illustrating a first exemplary embodiment of a display apparatus according to the present invention. FIG. 2 is a schematic diagram illustrating an exemplary embodiment of a pixel structure of an exemplary embodiment of a display panel in FIG. 1.

Referring to FIGS. 1 and 2, the display apparatus includes a display panel 100 and a driving apparatus 200 which drives the display panel 100.

The display panel 100 includes a first pixel row and a second pixel row. The first pixel row is extended along a first direction DI1 which is substantially parallel to a direction of extension of a data line, e.g., the first pixel row may also be referred to as "a pixel row". In one exemplary embodiment the first pixel row is electrically connected to a pair of data lines.

The second pixel row is extended along a second direction DI2 that is substantially parallel to a direction of extension of a gate line, e.g., the second pixel row may be referred to as "a pixel column". In one exemplary embodiment, the second pixel row is electrically connected to a single gate line.

In such an exemplary embodiment, the first pixel row includes a plurality of first pixels, and the second pixel row includes a plurality of second pixels. In the first exemplary embodiment, the first direction DI1 may be a horizontal direction and the second direction DI2 may be a vertical direction.

In the present exemplary embodiment, a plurality of unit pixels P, each of which includes N sub-pixels (wherein 'N' is a natural number), are formed in the display panel 100. M unit pixels P are arranged along the first direction DI1 so that N subpixels of each unit pixel P are also arranged along the first direction DI1 (wherein 'M' is a natural number). That is, the first pixel row includes M unit Pixels P. Additionally, T unit pixels are arranged along the second direction DI2 (wherein 'T' is a natural number). Accordingly, the second pixel row includes T unit pixels. In the present exemplary embodiment, T is smaller than M. That is, a horizontal dimension of the display panel 100 is longer than a vertical dimension of the display panel 100. However, it should be noted that a horizontal dimension of the display panel 100 may be shorter than a vertical dimension of the display panel 100.

In one exemplary embodiment, a pair of the data lines which are disposed adjacent to each other is electrically connected to sub-pixels of the first pixel row, and one of the gate lines is electrically connected to sub-pixels of a pair of the second pixel rows.

Referring to FIG. 2, the display panel 100 includes a plurality of data lines DLm, DLm+1, DLm+2 and DLm+3, a plurality of gate lines GLn, GLn+1 and GLn+2, and a plurality of unit pixels P (wherein 'm' and 'n' are natural numbers). In the present exemplary embodiment, each of the unit pixels P includes a red pixel R, a green pixel G and a blue pixel B.

In the present exemplary embodiment, the data lines DLm, DLm+1, DLm+2 and DLm+3 are extended in the first direction DI1, e.g., along the pixel row direction, and the gate lines GLn, GLn+1 and GLn+2 are extended in the second direction DI2, e.g., along the pixel column direction, substantially perpendicular to the first direction DI1. A first unit pixel P1 includes a first red pixel R1, a first green pixel G1 and a first blue pixel B1 which are disposed along the first direction DI1. A second unit pixel P2 is disposed adjacent to the first unit pixel P1 in the first direction DI1. The second unit pixel P2 includes a second red pixel R2, a second green pixel G2 and a second blue pixel B2 which are disposed along the first direction DI1.

Thus, a pair of data lines adjacent to each other is alternately and electrically connected to first pixels of the first pixel row extended in the first direction DI1.

In the present exemplary embodiment, in the first pixel row adjacent to the m-th data line DLm, the m-th data line DLm is electrically connected to a first red pixel R1, a second red pixel R2 and a second green pixel G2. The (m+1)-th data line DLm+1 is electrically connected to a first green pixel G1, a first blue pixel B1 and a second blue pixel B2.

In the first pixel row, e.g., the pixel row, adjacent to the (m+2)-th data line DLm+2, the (m+2)-th data line DLm+2 is electrically connected to a first green pixel G1, a first blue pixel B1 and a second blue pixel B2. The (m+3)-th data line DLm+3 is electrically connected to a first red pixel R1, a second red pixel R2 and a second green pixel G2.

In the present exemplary embodiment, the data lines DLm, DLm+1, DLm+2 and DLm+3 alternately receive substantially opposite polarity voltages.

Therefore, two of the first pixels of the first pixel row receive a first voltage and the next two of the first pixels of the first pixel row receive a second voltage different from the first voltage. In one exemplary embodiment, the second voltage may have a phase substantially opposite to that of the first voltage. Moreover, each of the second pixels of the second pixel row alternately receives different polarity voltages from each other along the second direction, e.g., as shown in FIG. 2, the first red pixel in the uppermost pixel row receives a polarity voltage corresponding to the data line DLm, while the first red pixel in the lowermost pixel column receives a polarity voltage corresponding to the data line DLm+3, which is substantially opposite to the polarity voltage of the data line DLm.

In one exemplary embodiment, the display panel 100 may use a 2-dot inversion driving method.

One of the gate lines is electrically connected to one of the second pixels in the second pixel row extended in the second direction DI2.

In one exemplary embodiment, the n-th gate line GLn is electrically connected to the first red pixel R1 and the first green pixel G1. The (n+1)-th gate line GLn+1 is electrically connected to the first blue pixel B1 and the second red pixel R2. The (n+2)-th gate line GLn+2 is electrically connected to the second green pixel G2 and the second blue pixel B2.

Here, a k-th unit pixel column LINE k and a (k+1)-th unit pixel column LINE (k+1) arranged in the first direction DI1 include three gate lines GLn, GLn+1 and GLn+2 (wherein "k" is a natural number). In such an exemplary embodiment, the GLn+1 gate line is shared between the unit pixel columns.

The driving apparatus 200 includes a timing control part 110, a driving voltage generator 130, a data driving part 150 and a gate driving part 170.

The timing control part 110 receives a synchronizing signal 101 and data 102 from an external device (not shown). In one exemplary embodiment, the synchronizing signal 101 includes a horizontal synchronizing signal, a vertical synchronizing signal and a data enable ("DE") signal synchronized with the horizontal synchronizing signal. In an exemplary embodiment wherein the display apparatus is configured to display color images, the data 102 includes red data, green data and blue data.

The timing control part 110 generates a gate control signal and a data control signal which control a driving timing of the driving apparatus 200 using the synchronizing signal 101. The timing control part 110 includes a storage part (not shown) which stores the data 102. In one exemplary embodiment, the timing control part 110 processes data corresponding to pixel structures of the display panel 100 through a data processing method for increasing data storage capacity and enhancing data processing reliability. The data processing method of the timing control part 110 will be described more fully hereinafter with reference to FIGS. 3, 4A and 4B.

The timing control part 110 receives M×N color data corresponding to M unit pixels of one pixel row for a single pulse duration of the received DE signal if a single pixel row includes M unit pixels and each unit pixel includes N color pixels (wherein M, N, T are natural numbers greater than or equal to 2). In this case, the timing control part 110 receives the M×N color data by N color data for a single unit pixel. The DE signal includes pulses having a duty cycle of a single horizontal period H and a blank interposed between every two adjacent pulses. The width of the blank may be variable.

Here, T rows of M×N color data are received for one frame of image. Thus, the display panel 100 may include pixels corresponding to the M×N×T color data. Accordingly, in one exemplary embodiment, the display panel 100 may display a frame with a M×T pixel resolution.

Moreover, in one exemplary embodiment, the display panel 100 may display a frame with a T×M pixel resolution.

In one exemplary embodiment, the timing control part 110 outputs the T×M color data by two color data corresponding to unit pixels of received two unit pixel columns. Thus, in the present exemplary embodiment, the timing control part 110 outputs red and green data for a first ⅔ H period. Hereinafter, the data of the k-th unit pixel column is referred to as k-th line data. Here, the data driving part 150 generate data voltages of an analog type corresponding to the received color data and outputs the data voltage of the analog type to the data lines DLm, DLm+1, DLm+2 and DLm+3.

The driving voltage generator 130 generates a driving voltage for driving the display apparatus using a power voltage received from an external device (not shown). In one exemplary embodiment, the driving voltage generator 130 supplies a digital power voltage DVDD and an analog power voltage AVDD to the data driving part 150. In the present exemplary embodiment, the driving voltage generator 130 also supplies a gate-on voltage VON and a gate-off voltage VOFF to the gate driving part 170.

The data driving part 150 is synchronized with the data control signal received from the timing control part 110. The data driving part 150 converts the data into analog data voltages and outputs the data voltages to the data lines of the display panel 100. In the present exemplary embodiment, the data driving part 150 converts data received in a ⅔ H period into an analog data voltages and outputs the data voltages to the data lines DLm, DLm+1, DLm+2 and DLm+3. In one exemplary embodiment, the data driving part 150 may be disposed at a side edge of the display panel 100 in a direction substantially parallel to the second direction DI2 in accordance with the pixel structure of display panel 100 as shown in FIG. 2. However, alternative exemplary embodiments include alternative configurations.

The gate driving part 170 is synchronized with the gate control signal received from the timing control part 110. The gate driving part 170 sequentially outputs gate signals including the gate-on voltage VON to the gate lines. In one exemplary embodiment, the gate driving part 170 may be disposed at a side edge of the display panel 100 in a direction substantially parallel with the first direction DI1 in accordance with the pixel structures of display panel 100 as shown in FIG. 2 although alternative exemplary embodiments include configurations wherein the gate driving part 170 may be disposed in alternative locations.

Figure 3:
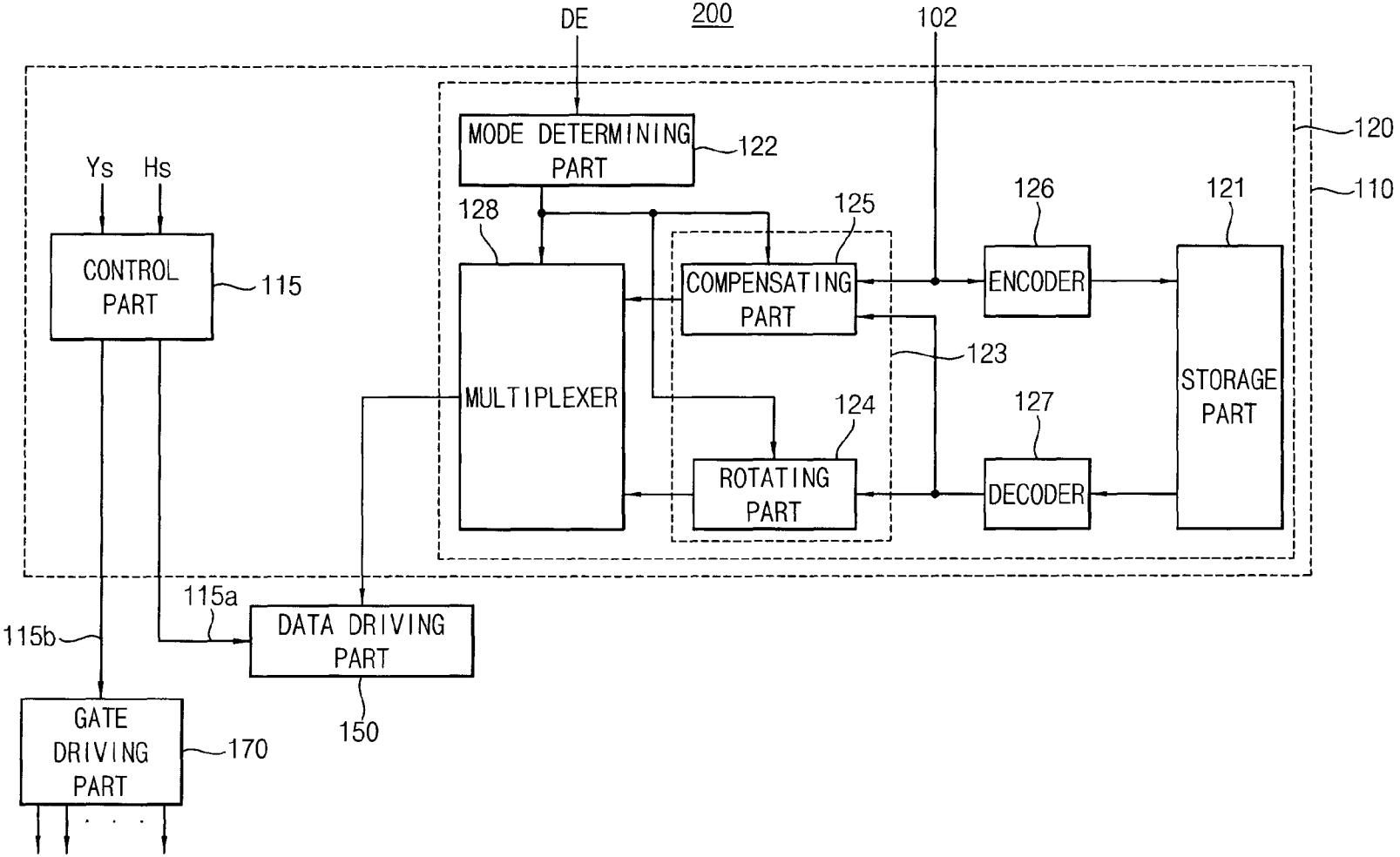
FIG. 3 is a block diagram illustrating an exemplary embodiment of the driving apparatus of FIG. 1.
Figure 4A:
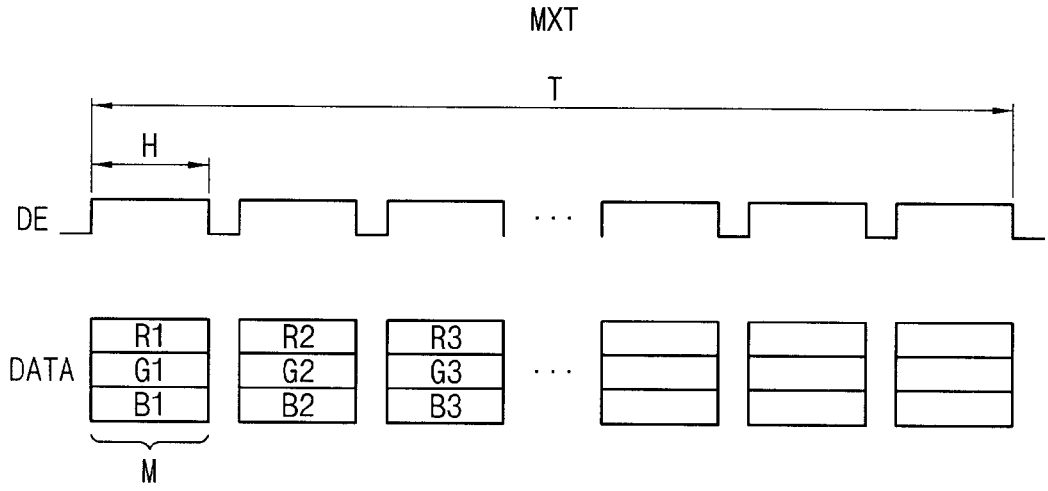
FIGS. 4A and 4B are timing diagrams illustrating an exemplary embodiment of a method for processing data to drive the exemplary embodiment of a display panel of FIG. 1.
Figure 4B:
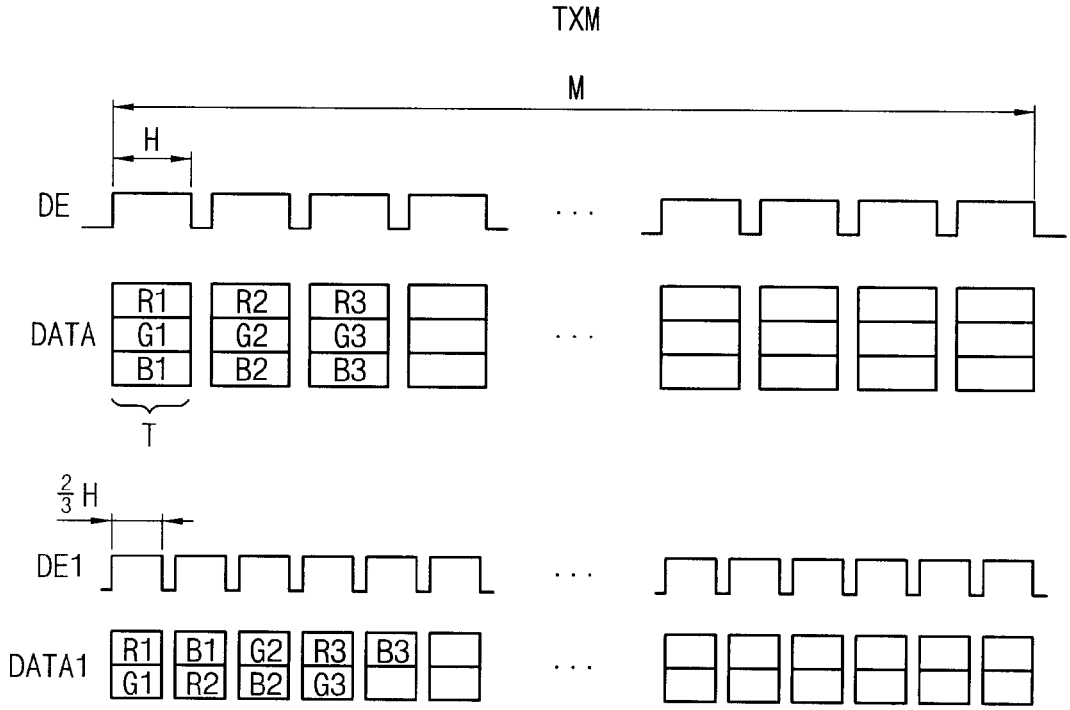

FIG. 3 is a block diagram illustrating an exemplary embodiment of the driving apparatus 200 of FIG. 1. FIGS. 4A and 4B are timing diagrams illustrating an exemplary embodiment of a method for processing data to drive the display panel 100 of FIG. 1.

Referring to FIGS. 1 to 4B, the driving apparatus 200 includes a timing control part 110, a data driving part 150 and a gate driving part 170.

In one exemplary embodiment, the timing control part 110 processes six color data corresponding to two unit pixel columns in accordance with a pixel structure of the display panel 100 as shown in FIG. 2.

The timing control part 110 includes a control part 115 and a data processing apparatus 120.

The timing control part 110 controls a driving of the data driving part 150 and the gate driving part 170 based on a received synchronizing signal such as a vertical synchronizing signal Vs, a horizontal synchronizing signal Hs and a DE signal.

The control part 115 provides the data driving part 150 with a data control signal 115*a* which includes, for example, a horizontal start signal STH, a load signal TP, and various other similar signals. The control part 115 provides the gate driving part 170 with a gate control signal 115*b* which includes, for example, a vertical start signal STV, clock signals CK and CKB, and various other similar signals.

The data processing apparatus 120 includes a storage part 121, a mode determining part 122 and a data processing part 123. The storage part 121 may be implemented outside the timing control part 110.

The storage part 121 stores image data of the p-th frame wherein p is a natural number.

The mode determining part 122 determines a display mode of the image data of the p-th frame based on data enable DE signals for the p-th frame. That is, the mode determining part 122 determines whether an output image is displayed on the display panel 100 in a non-self-pivotable display mode or a self-pivotable display mode based on the DE signal. In one exemplary embodiment, the non-self-pivotable display mode may be a basic input/output system ("BIOS") mode, and the self-pivotable display mode may be a Windows® mode. The BIOS mode itself cannot provide pivot-mode display while the Windows® mode itself can provide a pivot-mode display.

Image data for a display panel as illustrated in FIG. 2 should have a different data format from a data format for a conventional display panel which includes a gate driving unit located in a left side of the conventional display panel and a data driving unit located in a top side of the conventional display unit. For example, the display panel of FIG. 2 should have a frame data pivoted from the data of the conventional display panel. The Windows® mode can provide a frame data having a proper format according to a display panel type while, the BIOS mode cannot do that. In exemplary embodiments of the present invention, the timing control part 110 can convert image data having a non-proper data format into image data has proper data format, for example, pivoted data.

In one exemplary embodiment, the mode determining part 122 may set the display mode based on the number of pulses of the DE signal corresponding to the image data of the p-th frame.

In the exemplary embodiment as shown in FIG. 4A, when a resolution corresponding to the DE signal is M×T, that is, when the number of pulses of the DE signal corresponding to the image data of the p-th frame is T, the mode determining part 122 determines that the output image is displayed on the display panel 100 in the non-self-pivotable display mode, and the mode determining part 122 may set the display mode as the non-self-pivotable display mode.

In the exemplary embodiment as shown in FIG. 4B, when a resolution corresponding to the DE signal is T×M, that is, when the number of pulses of the DE signal corresponding to the p-th frame data is M, the mode determining part 122 determines that the output image is displayed on the display panel 100 in the self-pivotable display mode, and the mode determining part 122 may set the display mode as the self-pivotable display mode.

The data processing part 123 includes a rotating part 124 and a compensating part 125.

When the display mode is the non-self-pivotable display mode, the rotating part 124 rotates the image data of the p-th frame. For example, when a resolution corresponding to the DE signal is M×T, the rotating part 124 rotates the output image by about 90 degrees. Thus, the rotated output image may have a T×M pixel resolution. For example, in one exemplary embodiment the number of the pulses of the DE signal corresponding to the p-th frame data may be M.

Here, since the resolution corresponding to the DE signal is changed into TxM, the received DE signal is converted into a first DE signal DE1 which includes a first pulse having a width corresponding to a ⅔ H period, as shown in FIG. 4B. Accordingly, the first DE signal DE1 can drive the data driving part 150 in the display panel 100 as illustrated in FIG. 2.

When the display mode is the self-pivotable display mode, the compensating part 125 receives image data of the p-th and (p+1)-th frame and compensates the image data of the (p+1)-th frame based on the image data of the p-th frame.

For example, when a resolution corresponds to the DE signal is T×M, the mode determining part 122 determines that the output image is displayed on the display panel 100 in the self-pivotable display mode. In this case, the compensating part 125 compensates the image data of the (p+1)-th frame input just after the image data of the p-th frame while the rotating part 124 does not rotates the image data of the p-th frame by 90 degrees.

When the resolution corresponding to the DE signal is T×M, it means that the image data of the p-th frame that is already rotated by 90 degrees is input from an external device. Thus, the p-th frame data is not rotated by the data processing part 123. Instead, the data processing part 123 compensates the image data of the (p+1)-th frame by using a memory area of the storage part 121.

For example, in one exemplary embodiment, the compensating part 125 compares the image data of the p-th frame with the image data of the (p+1)-th frame, checks a compensation value corresponding to the comparing result at a lookup table (not shown), and compensates the image data of the (p+1)-th frame by the compensation value.

Then, the received image data without rotation is provided to the data driving part 150 by the first DE signal DE1 including a first pulse having the width of ⅔ H period as shown in FIG. 4B. Thus, the data driving part 150 may be driven.

Therefore, the output image is displayed on the display panel 100 without any rotation of the image data of the p-th frame. Here, the image data of the (p+1)-th frame is compensated so that changing of the output image may not be visible.

As shown in FIG. 1, in a default position the display panel 100 has a width that is shorter than its length, however, when the display panel 100 is rotated by about 90 degrees the width of the display panel 100 becomes longer than the length of the display panel 100. Thus, an image displayed on the display panel 100 may be turned 90 degrees from a normal position when a user views the display panel 100.

Thus, when the display panel 100 is rotated by 90 degrees, the image displayed on the display panel 100 is also rotated by 90 degrees, and the user may view the image in a normal orientation.

For example, in one exemplary embodiment, a window driver rotates the image by 90 degrees in the self-pivotable display mode and the data processing part 123 compensates the image data of the p-th frame. In contrast, the data processing part 123 rotates the image by 90 degrees in the non-self-pivotable display mode corresponding to the BIOS mode.

Therefore, an observer may view a normal image regardless of the display mode of external device. Moreover, the storage part 121 may be used in accordance with the display mode, so that a memory area may be reduced.

In one exemplary embodiment, the data processing apparatus 120 further includes an encoder 126, a decoder 127 and a multiplexer 128. The encoder 126 compressively encodes the image data of the p-th frame so that the storage part 121 stores the encoded image data of the p-th frame which has a small size. The decoder 127 decodes the encoded image data of the p-th frame data so that the data processing part 123 processes the image data of the p-th frame. The multiplexer 128 selectively outputs the rotated image data of the p-th frame from the rotating part 124 or the compensated image data of the (p+1)-th frame from the compensating part 125.

Figure 5:
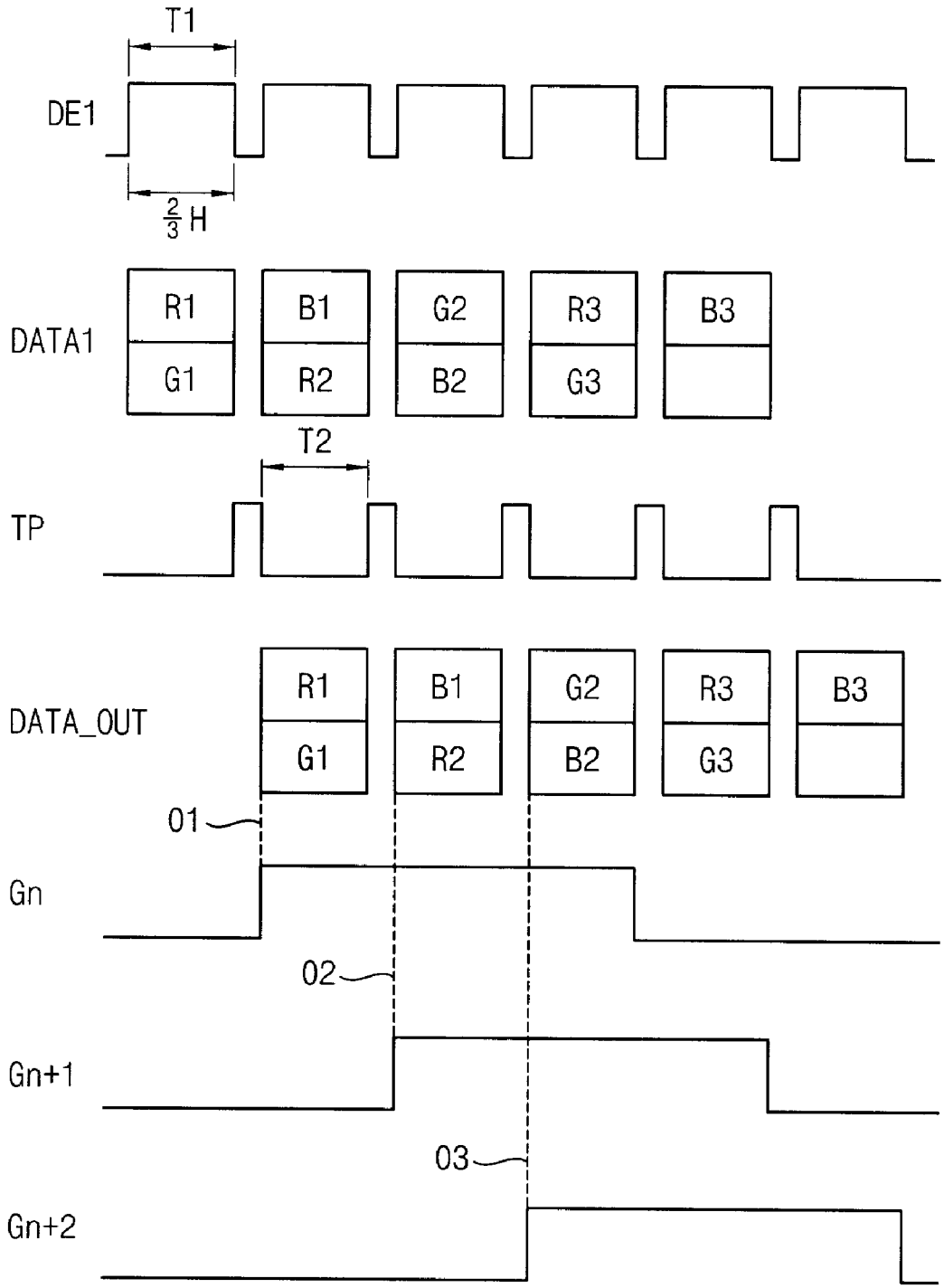
FIG. 5 is a timing diagram illustrating an exemplary embodiment of a driving method of the exemplary embodiment of a display panel of FIG. 1.

FIG. 5 is a timing diagram illustrating an exemplary embodiment of a driving method of the display panel 100 of FIG. 1.

Referring to FIGS. 1, 2 and 5, the data driving part 150 receives the red and green data R1 and G1 during a first interval T1 corresponding to a ⅔ H period in response to the first DE signal DE1. The data driving part 150 outputs the analog data voltage to the data lines DLm, DLm+1, DLm+2 and DLm+3 by converting the red and green data R1 and G1 into the analog data voltage during a second interval T2 in response to the load signal TP. The data driving part 150 outputs the analog data voltage to the data lines DLm, DLm+1, DLm+2 and DLm+3 by converting the blue and red data B1 and R1 that are provided during the next ⅔ H period into the analog data voltage in response to the load signal TP.

The gate driving part 170 sequentially outputs an n-th gate signal Gn, an (n+1)-th gate signal and an (n+2)-th gate signal to the n-th through (n+2)-th gate lines, respectively.

The n-th gate signal Gn is synchronized with a first point in time '01' at which a red data voltage R1 and a green data voltage G1 that are output from the k-th line, so that the n-th gate signal Gn is output to the n-th gate line GLn. The (n+1)-th gate signal G(n+1) is synchronized with a second point in time '02' at which a blue data voltage B1 that is output from the k-th line and a red data voltage R2 that is output from the (k+1)-th line, so that the (n+1)-th gate signal G(n+1) is output to the (n+1)-th gate line GLn+1. The (n+2)-th gate signal G(n+2) is synchronized with a third point in time '03' at which a green data voltage G2 and a blue data voltage B2 that are output from the (k+1)-th line, so that the (n+2)-th gate signal G(n+2) is output to the (n+2)-th gate line GLn+2. Thus, voltages are charged to the k-th and (k+1)-th unit pixel columns LINE k and LINE k+1.

Figure 6:
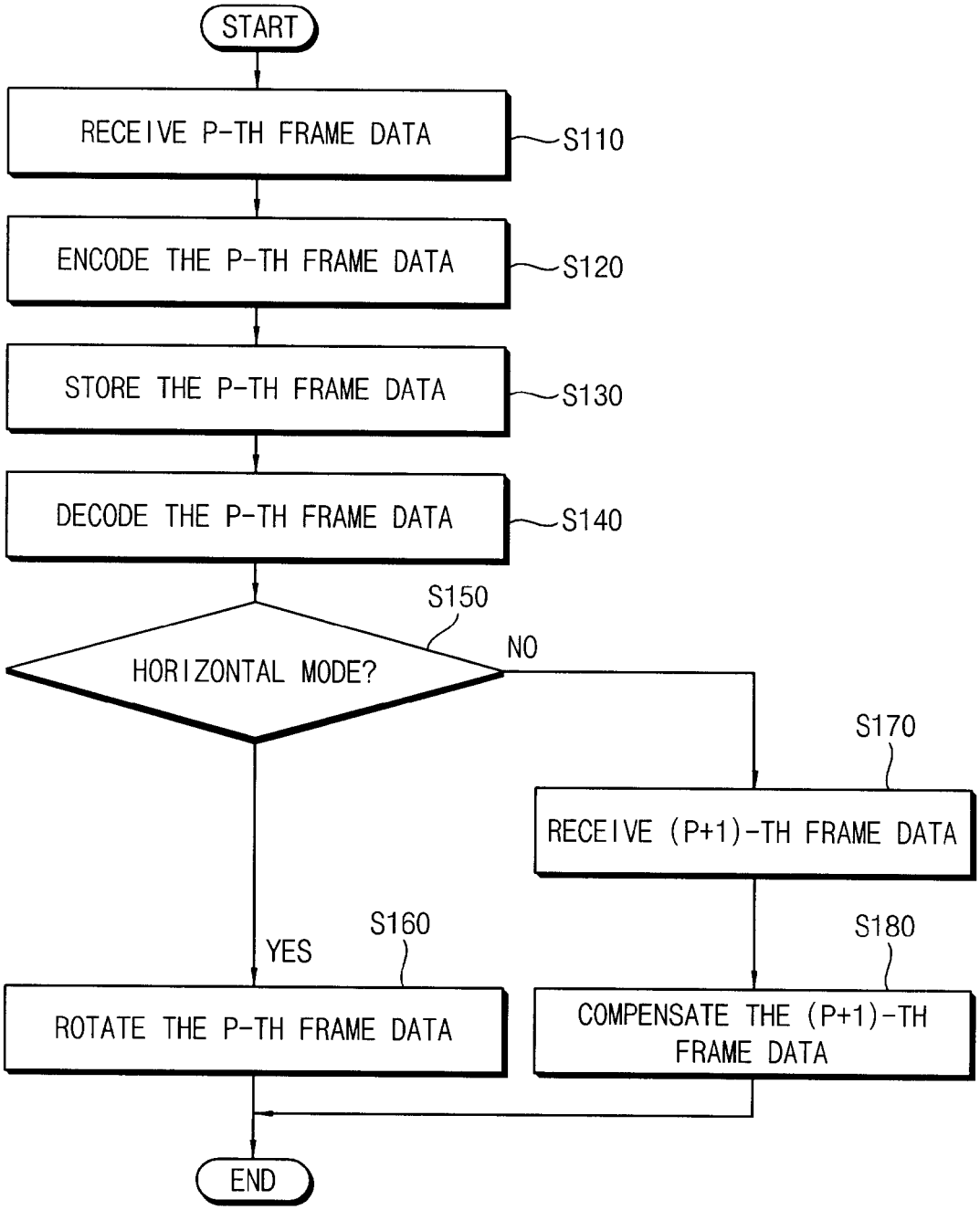
FIG. 6 is a flowchart illustrating an exemplary embodiment of a driving method of the exemplary embodiment of a display panel of FIG. 1.

FIG. 6 is a flowchart illustrating an exemplary embodiment of a driving method of the display panel of FIG. 1.

Referring to FIGS. 1, 3 and 6, the compensating part 125 and the encoder 126 receive the p-th frame data (step S110).

The encoder 126 encodes the p-th frame data (step S120). The storage part 121 stores the encoded p-th frame data (step S130). The storage part 121 stores the encoded p-th frame data so that a memory area may be reduced.

The decoder 127 decodes the stored p-th frame data so that the compensating part 125 and the rotating part 124 processes the p-th frame data (step S140).

The mode determining part 122 determines whether the output image is displayed on the display panel 100 in the non-self-pivotable display mode or the self-pivotable display mode based on the DE signal (step S150).

When the display mode is the non-self-pivotable display mode, the rotating part 124 rotates the p-th frame data (step S160).

When the display mode is the self-pivotable display mode, the compensating part 125 receives the (p+1)-th frame data (step S170), and compensates the (p+1)-th frame data based on the p-th frame data (step S180).

The multiplexer 128 selectively outputs the rotated image data of the p-th frame from the rotating part 124 or the compensated image data of the (p+1)-th frame from the compensating part 125.

According to the first exemplary embodiment, when the frame with a T×M pixel resolution corresponds to the DE signal, the p-th frame data that is already rotated by 90 degrees is input from an external device. Thus, the p-th frame data is not rotated by 90 degrees so that the (p+1)-th frame data is compensated using a memory area of the storage part 12*l*. Therefore, display quality may be enhanced.

Exemplary Embodiment 2

Figure 7:
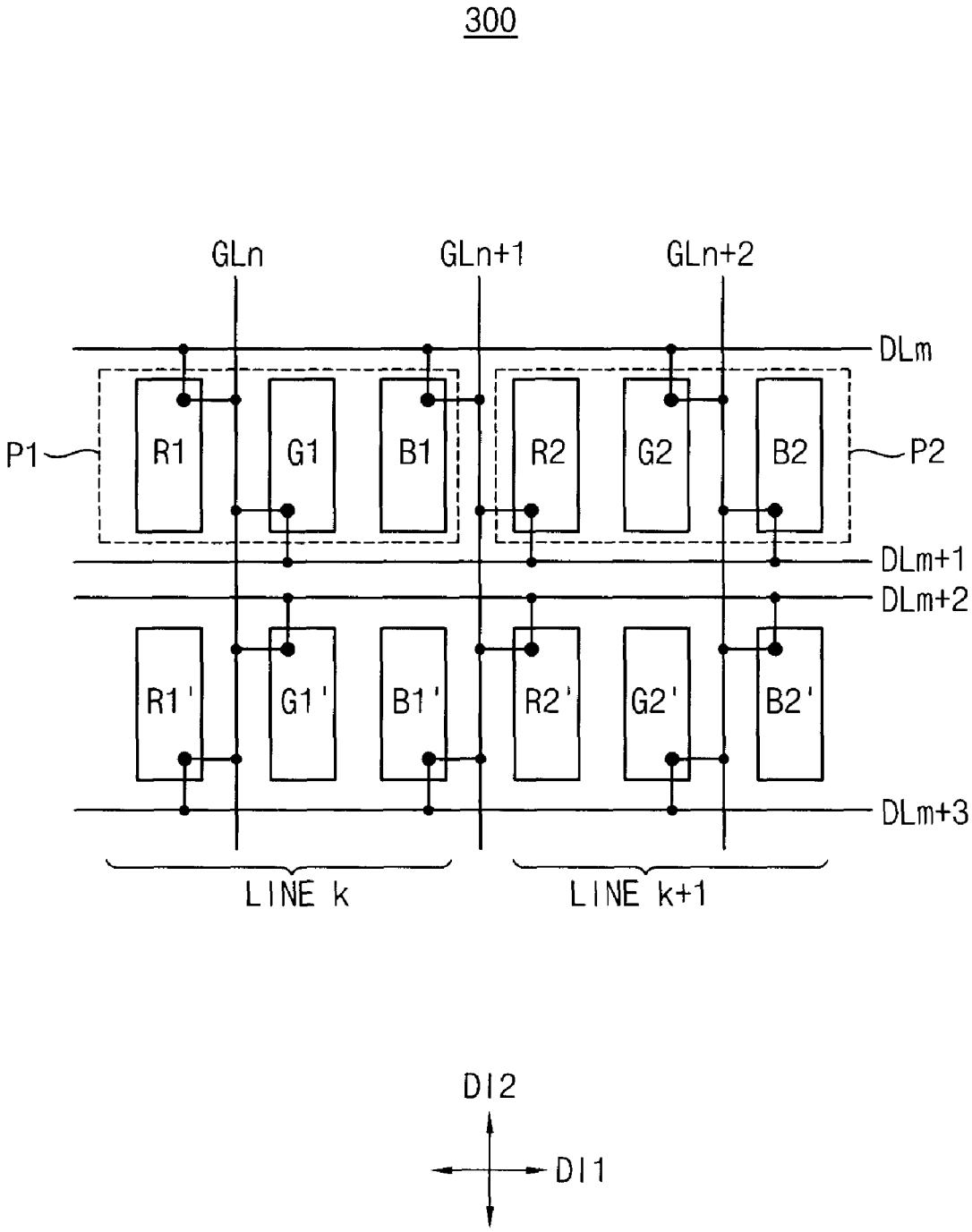
FIG. 7 is a schematic diagram illustrating a pixel structure of a second exemplary embodiment of a display panel according to the present invention.

FIG. 7 is a schematic diagram illustrating an exemplary embodiment of a pixel structure of a second exemplary embodiment of a display panel according to the present invention.

A block diagram of the second exemplary embodiment of a display apparatus is substantially the same as the block diagram of the previously described first exemplary embodiment of a display apparatus. Thus, the same reference numbers are used for the same elements, and repetitive descriptions will be omitted. Referring to FIGS. 1 and 7, the second exemplary embodiment of a display apparatus includes a display panel 300 and the driving apparatus 200.

A unit pixel P including N pixels (wherein N is a natural number) is defined in the display panel 300. The display panel 300 includes a first pixel row, also called a pixel row, extended along the first direction DI1 and a second pixel row, also called a pixel column extended along the second direction DI2. A pair of data lines which are disposed adjacent to each other is electrically connected to the first pixel row, and a single gate line is electrically connected to a pair of the second pixel rows that are disposed adjacent to each other.

For example, in the exemplary embodiment as illustrated in FIG. 2, the display panel 300 includes a plurality of data lines DLm, DLm+1, DLm+2 and DLm+3, includes a plurality of gate lines GLn, GLn+1 and GLn+2 and a plurality of unit pixels P (wherein m and n are natural numbers). In the present exemplary embodiment, each of the unit pixels P includes a red pixel R, a green pixel G, and a blue pixel B.

For example, in the present exemplary embodiment the data lines DLm, DLm+1, DLm+2 and DLm+3 are extended in the first direction DI1 and the gate lines GLn, GLn+1 and GLn+2 are extended in the second direction DI2 substantially crossing the first direction DI1. A first unit pixel P1 includes a first red pixel R1, a first green pixel G1 and a first blue pixel B1 which are disposed in the first direction DI1. A second unit pixel P2 is disposed adjacent to the first unit pixel P1 in the first direction DI1. The second unit pixel P2 includes a second red pixel R2, a second green pixel G2 and a second blue pixel B2 which are disposed in the first direction DI1.

The data lines are electrically and alternately connected to pixels arranged in the first direction DI1. That is, a pair of data lines adjacent to each other is electrically connected to first pixels of one of the first pixel row extended along the first direction.

For example, in the present exemplary embodiment in the first pixel row adjacent to the m-th data line DLm, the m-th data line DLm is electrically connected to a first red pixel R1, a first blue pixel B1 and a second green pixel G2. The (m+1)-th data line DLm+1 is electrically connected to a first green pixel G1, a second red pixel R2 and a second blue pixel B2. In the present exemplary embodiment, the pixels along the first pixel row, e.g., the pixel row, are alternately connected to the data lines disposed on either side thereof along the first direction DI1.

In the first pixel row adjacent to the (m+2)-th data line DLm+2, the (m+2)-th data line DLm+2 is electrically connected to a first green pixel G1', a second red pixel R2' and a second blue pixel B2'. The (m+3)-th data line DLm+3 is electrically connected to a first red pixel R1', a first blue pixel B1' and a second green pixel G2'.

Here, the data lines DLm, DLm+1, DLm+2 and DLm+3 alternately receive opposite polarity voltages.

Therefore, one of the first pixels of the first pixel row receives a first voltage and the next one of the first pixels of the first pixel row along the first direction DL1 receives a second voltage substantially opposite to the first voltage. Additionally, the second pixels of the second pixel row alternately receives the opposite polarity voltages.

That is, the display panel 300 may be driven through a 1-dot inversion driving method.

One of the gate lines is electrically connected to one of the second pixels in the second pixel row extended in the second direction DI2.

For example, in the present exemplary embodiment, the n-th gate line GLn is electrically connected to the first red pixel R1 and the first green pixel G1. The (n+1)-th gate line GLn+1 is electrically connected to the first green pixel B1 and the second red pixel R2. The (n+2)-th gate line GLn+2 is electrically connected to the second green pixel G2 and the second blue pixel B2.

Here, a k-th unit pixel column LINE k and a (k+1)-th unit pixel column LINE (k+1) disposed in the first direction DI1 are electrically connected to three gate lines GLn, GLn+1 and GLn+2 (wherein k is a natural number).

Therefore, a pair of unit pixel columns adjacent to each other is electrically connected to three gate lines so that the number of the gate lines may be reduced and the charging time of data voltages may be improved.

In the present exemplary embodiment, the driving apparatus 200 includes a timing control part 110, a driving voltage generator 130, a data driving part 150 and a gate driving part 170.

The timing control part 110 outputs the T×M color data by two color data corresponding unit pixels of received two unit pixel columns. Data of the k-th and (k+1)-th unit pixel columns is output during a 2 H period. Red data and green data of the k-th unit pixel column are output for a ⅔ H period. Blue data of the k-th unit pixel column and red data of the (k+1)-th unit pixel column is output for the next ⅔ H period. Green and blue data of the (k+1)-th unit pixel column is output for the next ⅔ H period. A block diagram of a driving apparatus according to the second exemplary embodiment is substantially the same as the block diagram of the driving apparatus according to the previously described first exemplary embodiment. Thus, the same reference numbers are used for the same elements, and repetitive descriptions will be omitted.

A schematic diagram illustrating a method for processing data for driving a display panel according to the second exemplary embodiment of the present invention is substantially the same as the schematic diagram illustrating the method for processing data in FIGS. 4A and 4B. Thus, the same reference numbers are used for the same elements, and repetitive descriptions will be omitted.

A timing diagram and a flowchart illustrating a driving method of a display panel according to the second exemplary embodiment is substantially the same as the timing diagram and the flowchart in FIGS. 5 and 6. Thus, the same reference numbers are used for the same elements, and repetitive descriptions will be omitted.

According to the second exemplary embodiment, when the frame with a T×M pixel resolution corresponds to the DE signal, the p-th frame data is not rotated by 90 degrees so that the (p+1)-th frame data is compensated by using a memory area of the storage part 121. Therefore, the display quality of the display panel 300 that uses the 1-dot inversion driving method may be enhanced.

As described above, according to exemplary embodiments of the present invention, when an output image is displayed in a horizontal mode, the output image is rotated by about 90 degrees to be displayed on a display panel. When an output image is displayed in a self-pivotable display mode, the output image, which is compensated so that changing of the output image may not be visible, may be displayed on the display panel. Therefore, the output image is always displayed on the display panel in a normal position when a user views the display panel and the output image is compensated when the output image is not rotated, so that the display quality of the display panel may be enhanced.

The foregoing is illustrative of the present invention and is not to be construed as limiting thereof. Although a few example embodiments of the present invention have been described, those skilled in the art will readily appreciate that many modifications are possible in the example embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific example embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. A method for processing image data, the method comprising:

storing image data of a p-th frame, wherein p is a natural number;

determining a display mode of the image data of the p-th frame based on the number of pulses of a data enable signal corresponding to the image data of the p-th frame; and processing the image data of the p-th frame in accordance with the determined display mode, wherein the processing the image data of the p-th frame comprises rotating the stored image data of the p-th frame when the determined display mode of the image data is a non-self-pivotable display mode in which a width of an image data is longer than a length of an image data.

2. The method of claim 1, wherein the processing the image data of the p-th frame further comprises compensating image data of a (p+1)-th frame using the stored image data of the p-th frame when the determined display mode of the image data is a self-pivotable display mode.

3. The method of claim 2, wherein the compensating the image data of the (p+1)-th frame is performed without rotating the stored image data.

4. The method of claim 2, wherein a width of the image data of a p-th frame of the non-self-pivotable display mode is longer than a length of the image data of the p-th frame of the non-self-pivotable display mode and the length of the image data of the p-th frame of the self-pivotable display mode is longer than the width of the image data of the p-th frame of the self-pivotable display mode.

5. The method of claim 2, wherein the non-self-pivotable display mode is a basic input/output system mode, and the self-pivotable display mode is a window mode.

6. The method of claim 1, further comprising:

compressively encoding the image data of a p-th frame before storing the image data of a p-th frame; and decoding the encoded image data of a p-th frame before processing the image data of a p-th frame.

7. An apparatus for processing data, the apparatus comprising:

a storage part which stores image data of a p-th frame, wherein p is a natural number;

a mode determining part which determines a display mode of the image data of the p-th frame based on the number of pulses of a data enable signal corresponding to the image data of the p-th frame; and a data processing part which processes the image data of the p-th frame to correspond to a display panel in accordance with the determined display mode, wherein the data processing part comprises:

a rotating part which rotates the image data of the p-th frame when the display mode is a non-self-pivotable display mode; and a compensating part which compensates image data of a (p+1)-th frame based on the image data of the p-th frame when the display mode is a self-pivotable display mode.

8. The apparatus of claim 7, further comprising:

an encoder which compressively encodes the image data of the p-th frame to provide the storage part with an encoded p-th frame image data; and a decoder which decodes the encoded p-th frame image data to provide the data processing part with a decoded p-th frame image data.

9. The apparatus of claim 7, wherein the compensating part comprises a lookup table which stores compensation data that is compensated image data of the image data of the (p+1)-th frame in correspondence with the image data of the p-th frame and the image data of the (p+1)-th frame.

10. The apparatus of claim 7, wherein a width of the image data of the p-th frame of the non-self-pivotable display mode is longer than a length of the image data of the p-th frame of the non-self-pivotable display mode and the length of the image data of the p-th frame of the self-pivotable display mode is longer than the width of the image data of the p-th frame of the self-pivotable display mode.

11. The apparatus of claim 10, wherein the non-self-pivotable display mode is a basic input/output system mode, and the self-pivotable display mode is a window mode.

12. The apparatus of claim 7, further comprising a multiplexer which selectively outputs one of an output signal of the compensating part and an output signal of the rotating part.

13. A display apparatus comprising:

a display panel comprising a data line extended in a horizontal direction and a gate line extended in a vertical direction substantially perpendicular to the horizontal direction, the gate line being shorter in length than the data line; and a data processing apparatus which processes image data of a p-th frame, wherein p is a natural number, according to a display mode of the image data of the p-th frame determined based on the number of pulses of a data enable signal corresponding to the image data of the p-th frame, wherein the data processing apparatus comprises:

a rotating part which rotates the image data of the p-th frame when the display mode is a non-self-pivotable display mode;

a compensating part which compensates image data of a (p+1)-th frame based on the image data of the p-th frame when the display mode is a self-pivotable display mode;

a storage part which stores image data of the p-th frame; and a mode determining part which determines the display mode based on the number of pulses of the data enable signal.

14. The display apparatus of claim 13, wherein the display panel comprises a plurality of first pixel rows each having a plurality of first pixels arranged along the horizontal direction and a plurality of second pixel rows each having a plurality of second pixels arranged along the vertical direction, and a pair of data lines is electrically connected to one of the plurality of first pixel rows, and a gate line is electrically connected to a pair of second pixel rows of the plurality of second pixel rows.

15. The display apparatus of claim 14, wherein the mode determining part determines the display mode as the self-pivotable display mode when the number of pulses corresponding to the image data of a p-th frame is substantially equal to the number of the second pixels.

16. The display apparatus of claim 14, wherein the mode determining part determines the display mode as the non-self-pivotable display mode when the number of the pulses corresponding to the image data of a p-th frame is substantially different from the number of the second pixels.

17. The display apparatus of claim 14, wherein two of the first pixels are connected to a single data line of the pair of data lines, and two subsequent first pixels along the vertical direction are connected to another single data line of the pair of data lines.

18. The display apparatus of claim 14, wherein one of the first pixels is connected to a single data line of the pair of data lines and an adjacent first pixel along the vertical direction is connected to the other data line of the pair of data lines.

19. The display apparatus of claim 13, wherein the data processing apparatus comprises a multiplexer which selectively outputs one of an output signal of the compensating part and an output signal of the rotating part in response to the display mode.

* * * * *